US009115680B2

(12) United States Patent
Chu

(10) Patent No.: US 9,115,680 B2
(45) Date of Patent: Aug. 25, 2015

(54) HAND-OPERATING STARTING DEVICE WITH CLUTCH STRUCTURE

(71) Applicant: Daimler Chu, New Taipei (TW)

(72) Inventor: Daimler Chu, New Taipei (TW)

( * ) Notice: Subject to any disclaimer, the term of this patent is extended or adjusted under 35 U.S.C. 154(b) by 0 days.

(21) Appl. No.: 14/672,215

(22) Filed: Mar. 29, 2015

(65) Prior Publication Data

US 2015/0204296 A1 Jul. 23, 2015

Related U.S. Application Data

(63) Continuation-in-part of application No. 14/053,604, filed on Oct. 15, 2013.

(30) Foreign Application Priority Data

| | | |
|---|---|---|
| Sep. 18, 2013 | (TW) | 102133775 A |
| Apr. 30, 2014 | (TW) | 103207561 U |
| Nov. 5, 2014 | (TW) | 103219614 U |

(51) Int. Cl.
*F02N 3/02* (2006.01)

(52) U.S. Cl.
CPC ..... *F02N 3/02* (2013.01)

(58) Field of Classification Search
CPC ..... F02N 3/02
USPC ..... 123/185.7, 185.2, 185.3, 179.27
See application file for complete search history.

(56) References Cited

U.S. PATENT DOCUMENTS

| | | | | |
|---|---|---|---|---|
| 4,637,360 | A * | 1/1987 | Osakabe | 123/185.2 |
| 5,765,438 | A * | 6/1998 | Chang | 123/185.3 |
| 6,994,066 | B2 * | 2/2006 | Liu | 123/185.3 |
| 6,997,155 | B1 * | 2/2006 | Lu | 123/179.25 |
| 7,343,891 | B1 * | 3/2008 | Chang | 123/185.3 |
| 2002/0139341 | A1 * | 10/2002 | Tsuno | 123/185.3 |
| 2004/0065161 | A1 * | 4/2004 | Yeh | 74/6 |
| 2004/0134293 | A1 * | 7/2004 | Lai | 123/185.3 |
| 2005/0211216 | A1 * | 9/2005 | Otsuki | 123/185.3 |
| 2005/0268876 | A1 * | 12/2005 | Liu | 123/185.3 |

* cited by examiner

*Primary Examiner* — Stephen K Cronin
*Assistant Examiner* — Arnold Castro
(74) *Attorney, Agent, or Firm* — Leong C. Lei

(57) ABSTRACT

A hand-operating starting device with clutch structure is mounted to one side of an engine and includes a driving portion and a driven portion. The driving portion includes a housing. A rotary member that is received in the housing and has a pull cord wounded thereon is provided with an elastic member and an axle having a positioning pin projecting therefrom. The driven portion includes a cover that covers the housing. The cover receives therein a sleeve for driving the engine. The sleeve includes a helical channel and is fit over the axle with the positioning pin received in and guided by the helical channel. A bearing arranged between the driving and driven portions for rotatably coupling with the axle and an O-ring is arranged around the bearing. The engine has a main shaft having an eccentric peg having a slope surface formed on an outer end thereof.

4 Claims, 17 Drawing Sheets

HAND-OPERATING STARTING DEVICE WITH CLUTCH STRUCTURE

CROSS-REFERENCE TO RELATED APPLICATION

This is a continuation-in-part of co-pending U.S. patent application Ser. No. 14/053,604 filed on Oct. 15, 2013 and owned by the present applicant.

TECHNICAL FIELD OF THE INVENTION

The present invention generally relates to a starting device applicable to starting an engine of for example a remote control vehicle, a yacht, a lawnmower, and a power generator, and more particularly to a hollowed casing structure of a cable reel.

DESCRIPTION OF THE PRIOR ART

A regular remote control vehicle generally comprises an engine that is started by an electrically operating starting device. An example is disclosed in Taiwan Patent No. 242278, which discloses an improved structure of an ancillary starting device of an engine of a remote control vehicle, wherein the structure is characterized by comprising a driving gear train and a driven gear train. The driving gear train comprises a housing and the housing has a circumference that is provided with a hollow axle sleeve set at an angle of around 45 degrees and in communication with a receiving section. The hollow axle sleeve receives an axle extending therethrough. The axle has a top end forming a coupling section. The axle has a bottom end to which a driving bevel gear is mounted in such a way that the driving bevel gear is located in the housing. The driven gear train comprises a cover that is set on the housing. The cover comprises a through hole that receives and retains therein a one-way bearing. The one-way bearing receives a spindle extending therethrough. The spindle has an end to which a driven bevel gear is mounted to mate the driving bevel gear. The spindle has an opposite end coupled to the engine of the remote control vehicle. As such, an electrically operating tool is insertable into the coupling section of the driving gear train for rotation so as to drive the spindle of the driven gear train to rotate to thereby start the engine coupled to the opposite end of the spindle.

Thus, the structure disclosed in the Taiwan patent can be operated electrically for staring the engine. However, the engine, after being started, is put into operation and the spindle that is coupled to the engine is forced to rotate with the operation of the engine. Since the driven bevel gear that is mounted to an end of the spindle is in engagement with the driving bevel gear, the driving gear train is also forced to move. As a result, the power output of the engine is impeded by the driving gear train so as to result in a loss of power. Thus, it is desired to provide a starting device that comprises a clutch structure and to have a starting structure thereof disengaging from a spindle of an engine after the engine has been started so as to avoid power loss of the engine.

If the engine is not designed to separate from the starting structure of an engine starting device after starting, then a common solution is to provide a one-way bearing in the starting device. However, the power output of the engine may still be impeded (generally in the form of speed reduction and loading), to some extents, by the starting structure of the engine starting device. Consequently, the idle speed of the engine must be raised and this certainly leads to additional consumption of fuel.

Further, to use a remote control vehicle that includes an electrically operating starting device outdoors, a user need to carry associated electrically operating tools and equipment. This increases carrying loading and also causes concern about when the electrically operating starting device runs out of electrical power without being timely noticed. Thus, it is desired to provide a hand-operating starting device.

However, although a hand-operating starting device may be of a structure that comprises a driving portion comprising, arranged therein, a rotary member and an axle that are rotatable to drive a sleeve arranged in a driven portion and comprising a helical channel formed therein that is structured to achieve a clutching operation of simultaneous rotation and axial movement, which enables the starting structure that drives the engine to start to disengage from a main shaft of the engine after the engine is started, in order to prevent unnecessary consumption and loss of engine power, yet the rotary member and the axle, which are arranged in the driving portion of the starting device to drive the sleeve of the driven portion to rotate and move, are supported by an end of the axle rotatably received in a recess formed in an inside surface of a housing to serve as the only supporting axis for the rotation thereof, so that the stability and smoothness of the operation of the starting device are poor when it is operated by being pulled with a hand operation. Further, since the sleeve of the driven portion is fit, in a movable manner, over the axle and extends through the cover and is arranged at one side of the engine to communicate with the interior of the engine, it is very likely that oil vapor from an engine chamber can be driven into the starting device to lead to leakage of oil.

Referring to FIGS. 14, 15, and 15*a*, although the previously described structure involves a clutching arrangement therein to allow the structure that drive the engine 3 to start to separate from the main shaft 35 of the engine 3 for eliminating unnecessary consumption and loss of engine power, in actual operation, it is generally hard to control where the eccentric peg 36*a* of the main shaft 35 may be located when the engine 3 stops. If the eccentric peg 36*a* happens to be located on a path of movement of the fixation pin 231 of the sleeve 23, the fixation pin 231 may get in engagement with an end of the eccentric peg 36*a* and gets fixed and not movable forward (as illustrated in FIG. 15*a*). This situation of jamming may occasionally occur when a user operates the device to start up an engine 3. This may readily cause damage to internal components and the pull cord 14 may get broken under the action of a strong pulling force, or even hurting the hand of the user. This is surely not an ideal arrangement.

Thus, the present invention aims to provide improvements to overcome the above drawbacks by providing a starting device that assists starting of an engine and is applicable to a yacht engine, a lawnmower engine, or a power generator engine.

SUMMARY OF THE INVENTION

An object of the present invention is to provide a hand-operating starting device with clutch structure, which comprises an arrangement constituted by a positioning pin and helical channel to allow for both axial movement and rotation, whereby after a user has started an engine, the starting structure that drives the engine is separated from a main shaft of the engine so as to avoid loss of power of the engine.

Another object of the present invention is to provide a hand-operating starting device with clutch structure, which provides a further improvement of the structure of the starting device to achieve a more stable and smoother operation thereof and to prevent leaking of engine oil so as to make the performance of the entire structure of the starting device perfect.

A further object of the present invention is to provide a hand-operating starting device that comprises a jamming elimination structure for the hand-operating starting device, in which a slope surface is formed on an end of an eccentric peg of a main shaft of an engine to provide a safer and smoother operation for a user and to prevent potential risk of jamming of the starting device during the operation thereof To achieve the objects, the present invention is mounted to one side of an engine and comprises a driving portion and a driven portion. The driving portion comprises a housing forming a receiving section. The receiving section receives therein a rotary member around which a pull cord is would. The pull cord has an end extending outside the housing. The pull cord has an opposite end fixed to the rotary member. The rotary member comprises an elastic member mounted to one end thereof to provide a restoration force for reverse rotation of the rotary member after the rotary member has been rotated. The rotary member is coupled to an axle. The axle has a surface from which a positioning pin projects. The driven portion comprises a cover, which is set to cover the receiving section of the housing. A bearing is arranged at a location where the cover is set to rotatably couple the axle for serving as a supporting axis for rotation. An O-ring is set around an outer circumference of the bearing. A sleeve that comprises a fixation pin and a helical channel formed thereon is received in the cover in such a way that the sleeve is movably fit over the axle and the positioning pin is received in and guided by the helical channel, whereby the sleeve is rotatable and is movable, during the rotation thereof, to a position where the fixation pin is in driving engagement with the engine. As such, assistance is provided for starting up an engine. After the engine has been started, the fixation pin is allowed to separate from a driving position for driving the engine so that the power output of the engine is not impeded by the sleeve and no loss of power will be caused.

Further, the main shaft of the engine comprises an eccentric peg that has an end face on which a slope surface is formed in such a way that the slope surface inclines in the rotation direction (clockwise) of the main shaft. When the eccentric peg of the engine main shaft is on a path of the movement of the fixation pin of the sleeve, the arrangement of the slope surface allows the fixation pin of the sleeve to be guided by and move along the slope surface in direction away from engagement thereof with the end face of the eccentric peg so that the fixation pin may get into contact and engagement with a side surface of the eccentric peg and thus driving a piston crank to move for starting up the operation of the engine. As such, jamming of the engine during staring up by the starting device can be eliminated.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
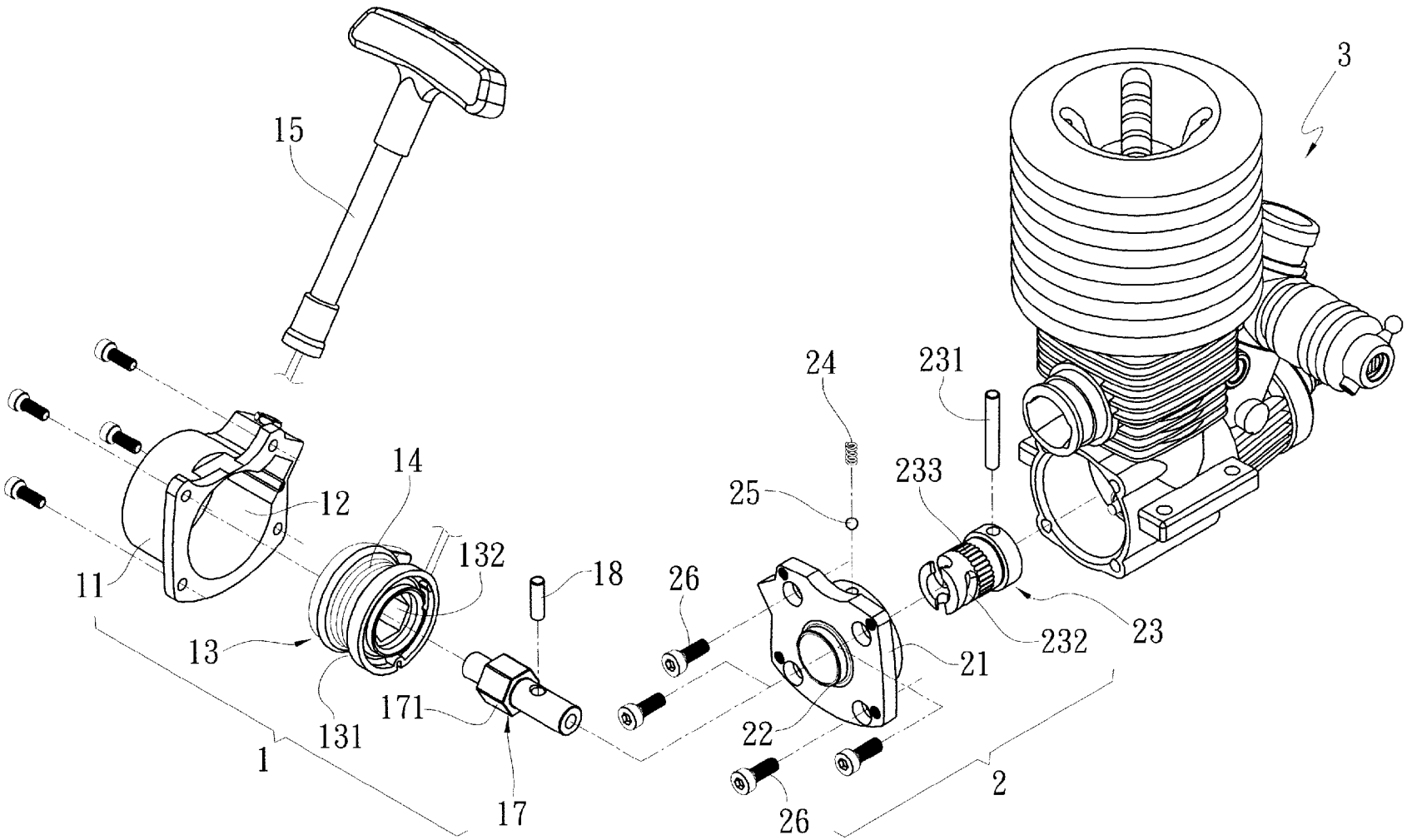
FIG. 1 is an exploded view of a first embodiment of the present invention.
Figure 2:
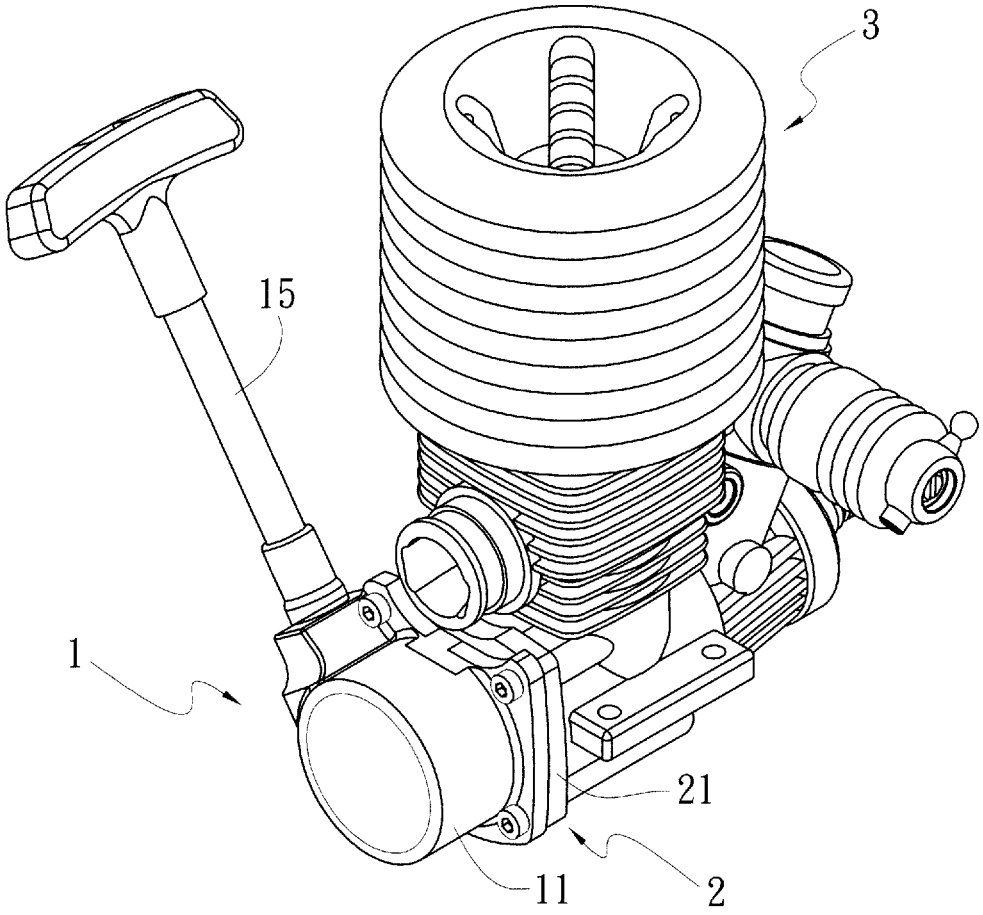
FIG. 2 is a perspective view of the first embodiment of the present invention.
Figure 3:
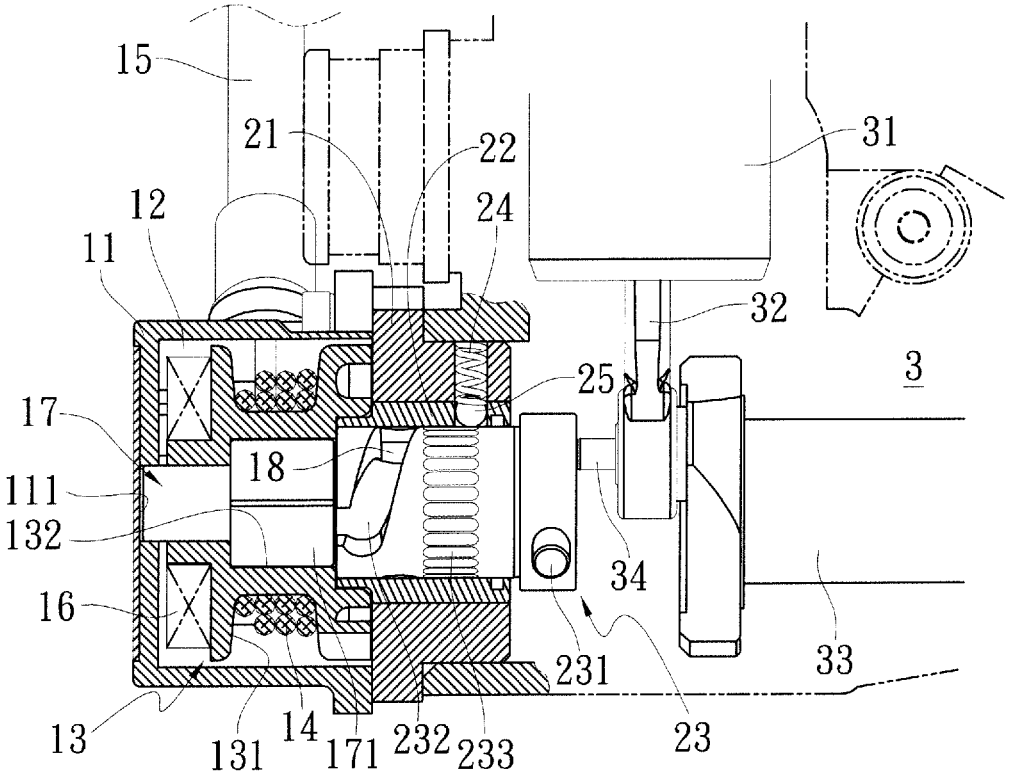
FIG. 3 is a cross-sectional view of the first embodiment of the present invention.

Referring to FIGS. 1-3, the present invention is mounted to one side of an engine 3. The engine 3 can be for example an engine of a remote control vehicle, an engine of a yacht, an engine of a lawnmower, or an engine of a power generator. A preferred embodiment of the present invention comprises a driving portion 1 and a driven portion 2.

The driving portion 1 comprises a housing 11. The housing 11 has an interior that defines a hollow receiving section 12. The receiving section 12 receives therein a rotary member 13. The rotary member 13 comprises a groove 131 formed therein for receiving a predetermined length of a pull cord 14 wound therein. The pull cord 14 has an end extending out of the housing 11 and coupled to a T-shaped handgrip 15, whereby a user is allowed to grip the handgrip 15 with a hand for pulling the pull cord 14 to rotate the rotary member 13. The pull cord 14 has an opposite end that is fixed to the rotary member 13. Mounted to one end of the rotary member 13 is an elastic member 16 (see FIG. 3) that, after the rotary member 13 has been rotated in a forward direction, provides a restoration force for reverse rotation of the rotary member 13. The elastic member 16 can be for example a spring. The rotary member 13 comprises a polygonal bore 132 formed therein. In the instant embodiment, the polygonal bore 132 is a hexagonal hole having six interconnected sides. An axle 17 comprises a polygonal coupling section 171 that corresponds in shape to the polygonal bore 132 so as to allow the polygonal coupling section 171 to be fit into the polygonal bore 132 to have the rotary member 13 coupled to the axle 17 for driving the axle 17 to rotate. Further, the axle 17 has an end that extends beyond the rotary member 13 to be rotatably received in a recess 111 defined in an inside surface of the housing 11 (see FIG. 3), serving as a supporting axis supporting the rotation of the rotary member 13 and the axle 17. Further, the axle 17 has a circumferential surface from which a positioning pin 18 projects.

The driven portion 2 comprises a cover 21. The cover 21 is fixed by a plurality of threaded fasteners (not shown) extending therethrough so as to cover and close the receiving section 12 of the housing 11. The cover 21 is further fixed by a plurality of additional threaded fasteners 26 extending therethrough to the side of the engine 3 so as to allow the present invention to be mounted to the side of the engine 3. The cover 21 comprises a lining 22 for wear/abrasion resistance and a sleeve 23 that is received in the lining 22 and comprises a fixation pin 231 and a helical channel 232 formed thereon. The helical channel 232 is formed, circumferentially, in a circumferential surface of the sleeve 23 and extends by a predetermined length. The sleeve 23 is movably fit over the axle 17 in such a way that the positioning pin 18 is movably received in and guided by the helical channel 232 to move along the helical channel 232, serving as a structure for achieving both rotation and axial movement, for driving an axial movement of the sleeve 23 along the axle 17 and allowing the sleeve 23 to rotate with respect to the axle 17. Further, due to the positioning pin 18 being guided, in a helical manner, by the helical channel 232, the sleeve 23 may cause the fixation pin 231 to move to a location to drive the engine 3.

The circumferential surface of the sleeve 23 is provided with a plurality of positioning grooves 233 circumferentially arranged thereon. The cover 21 is provided with a spring 24 that is arranged in a radial passage of the cover so that the spring 24 biases a positioning ball 25 to set the positioning ball 25 in an elastically biased condition to selectively fit into and engage one of the positioning grooves 233. As such, the sleeve 23 is allowed to move forward and backward in the axial direction along the axle 17, while positionability can be achieved during a backward axial movement of the sleeve 23 after the engine has been started in order to prevent the sleeve 23 from being undesirably moved forward caused by the vibration of the operation of the engine.

Figure 4:
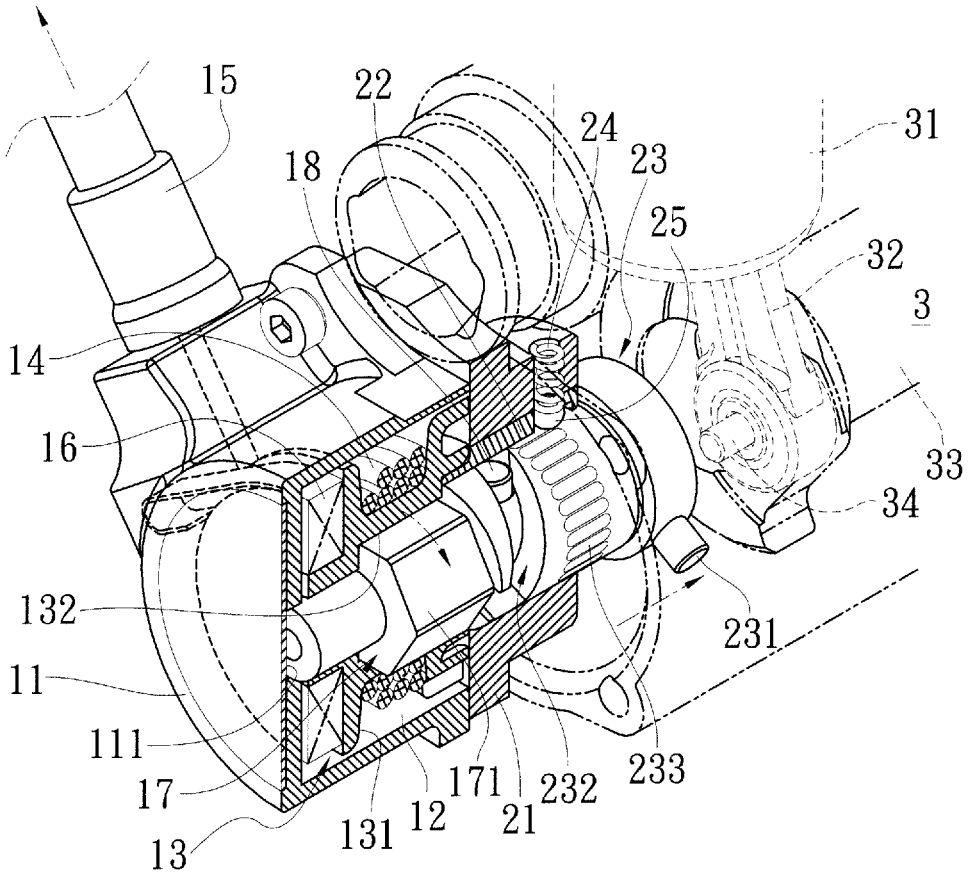
FIG. 4 is a schematic view, partially broken, illustrating a starting operation of the first embodiment of the present invention.
Figure 4A:
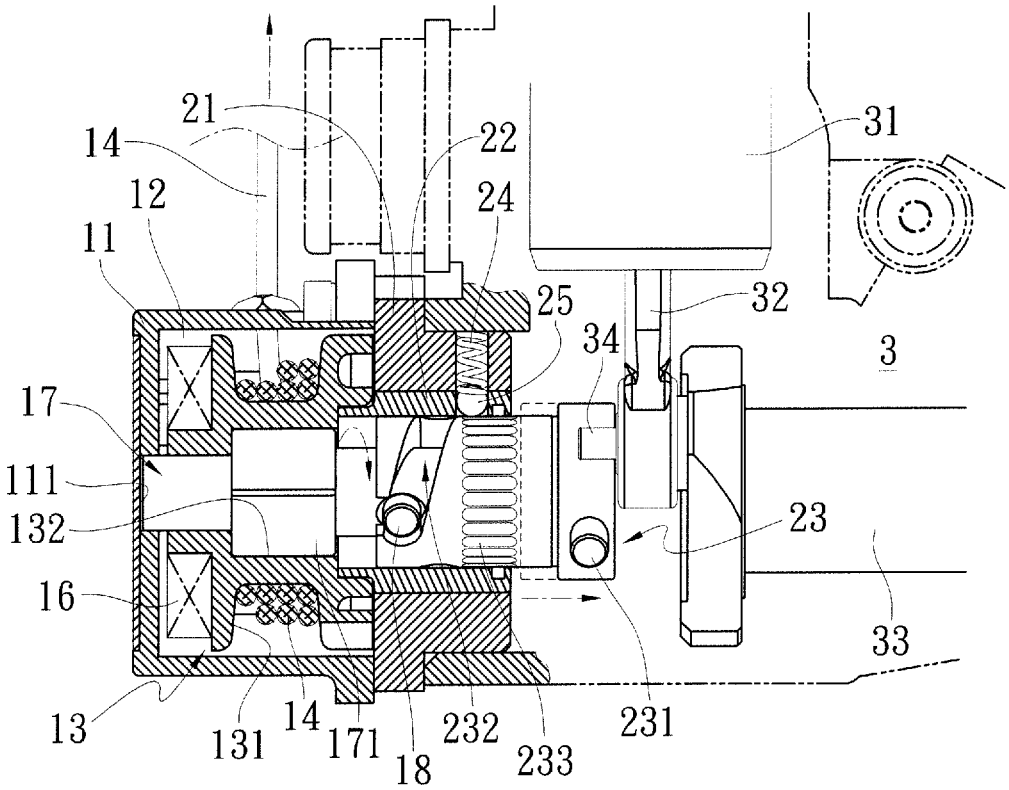
FIG. 4A is a cross-sectional view of FIG. 4.

Referring to FIGS. 4 and 4A, the engine 3 operable by the present invention generally has a structure that comprises a piston 31 having a crank 32 set at a bottom portion thereof. The piston 31 is connected, via an end of the crank 32, to and drives an eccentric shaft 34 of a main shaft 33. To start up the engine 3, a user uses the handgrip 15 to pull the pull cord 14 so as to cause the rotary member 13, together with the axle 17, to rotate. The axle 17 drives the positioning pin 18 to rotate. Since the positioning pin 18 is received, in a manner of being guided thereby, in the helical channel 232 of the sleeve 23, the positioning pin 18 is rotated along the helical channel 232 and thus moved axially. During the movement of the positioning pin 18, the positioning pin 18 is rotated while being kept at a fixed axial position, and due to the guidance of movement in a helical manner achieved with the helical channel 232, the sleeve 23 is caused to make an axial movement. With the positioning pin 18 received in the helical channel 232, a driving force is applied thereby to a side wall of the helical channel 232 to drive the sleeve 23 to move axially along and with respect to the axle 17 in such a manner that the sleeve 23 moves towards the engine 3, whereby the sleeve 23 is allowed to reach such a position where the fixation pin 231 engages and drives the eccentric shaft 34 of the engine 3.

Figure 5:
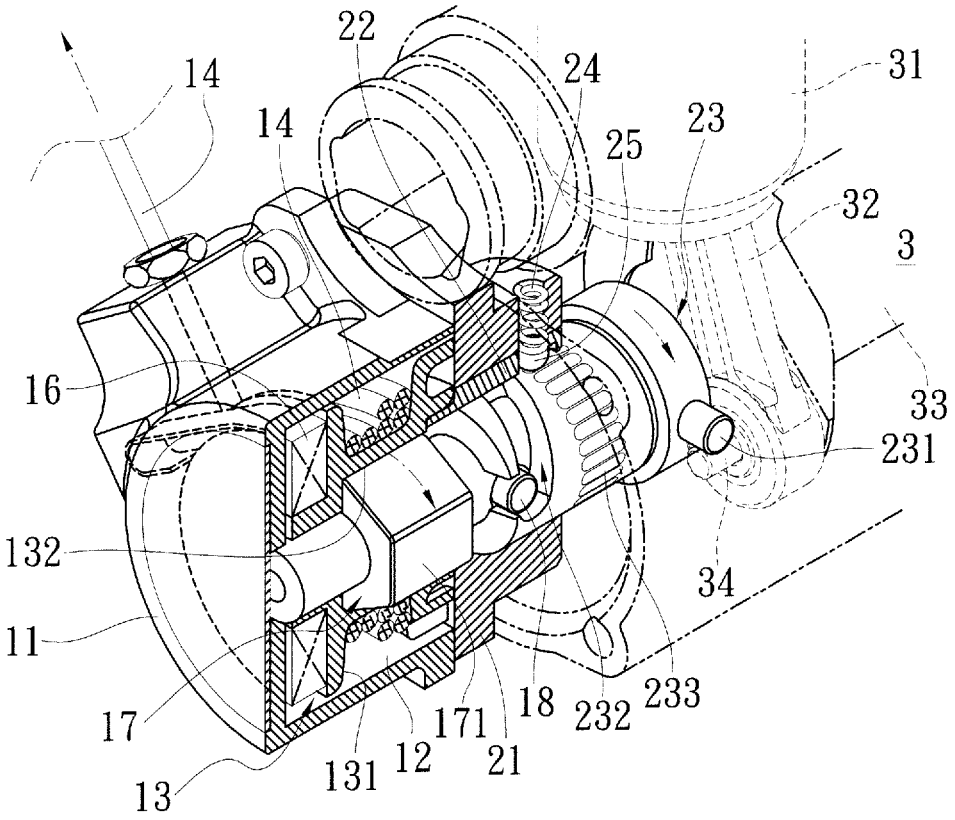
FIG. 5 is another schematic view, partially broken, illustrating the starting operation of the first embodiment of the present invention.
Figure 5A:
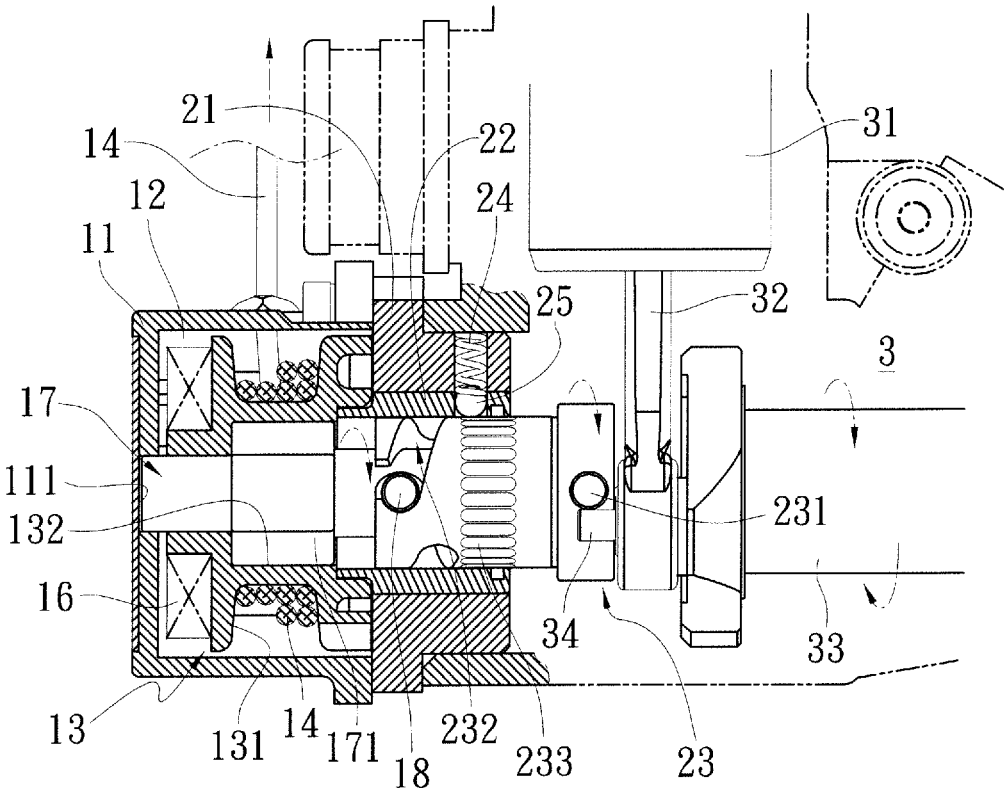
FIG. 5A is a cross-sectional view of FIG. 5.

Referring to FIGS. 5 and 5A, what is shown in the drawings is that the handgrip 15 has been pulled outward to cause the pull cord 14 to drive the axle 17 to rotate. When the positioning pin 18 is rotated at a fixed axial position so as to move downward through a relative movement with respect to and along the helical channel 232 to reach and be retained at a bottom closed end of the helical channel 232 (which corresponds to a bottom dead center), the sleeve 23 stops axially moving and the sleeve 23 is kept rotation at the fixed position of the bottom dead center. As such, the length that the sleeve 23 extends in the forward direction can be limited to ensure the fixation pin 231 is located at the position engaging and driving the engine 3 and to prevent excessive extension of the sleeve 23.

When the extension length of the sleeve 23 reaches the fixed length, the positioning pin 18 applies a driving force to the lower closed end of the helical channel 232 to drive the sleeve 23 to synchronously rotate with the axle 17, whereby the fixation pin 231 may drive the eccentric shaft 34 of the engine 3 to cause the main shaft 33 of the engine 3 to rotate and thus starting up the engine 3 (see FIG. 5A).

Figure 6:
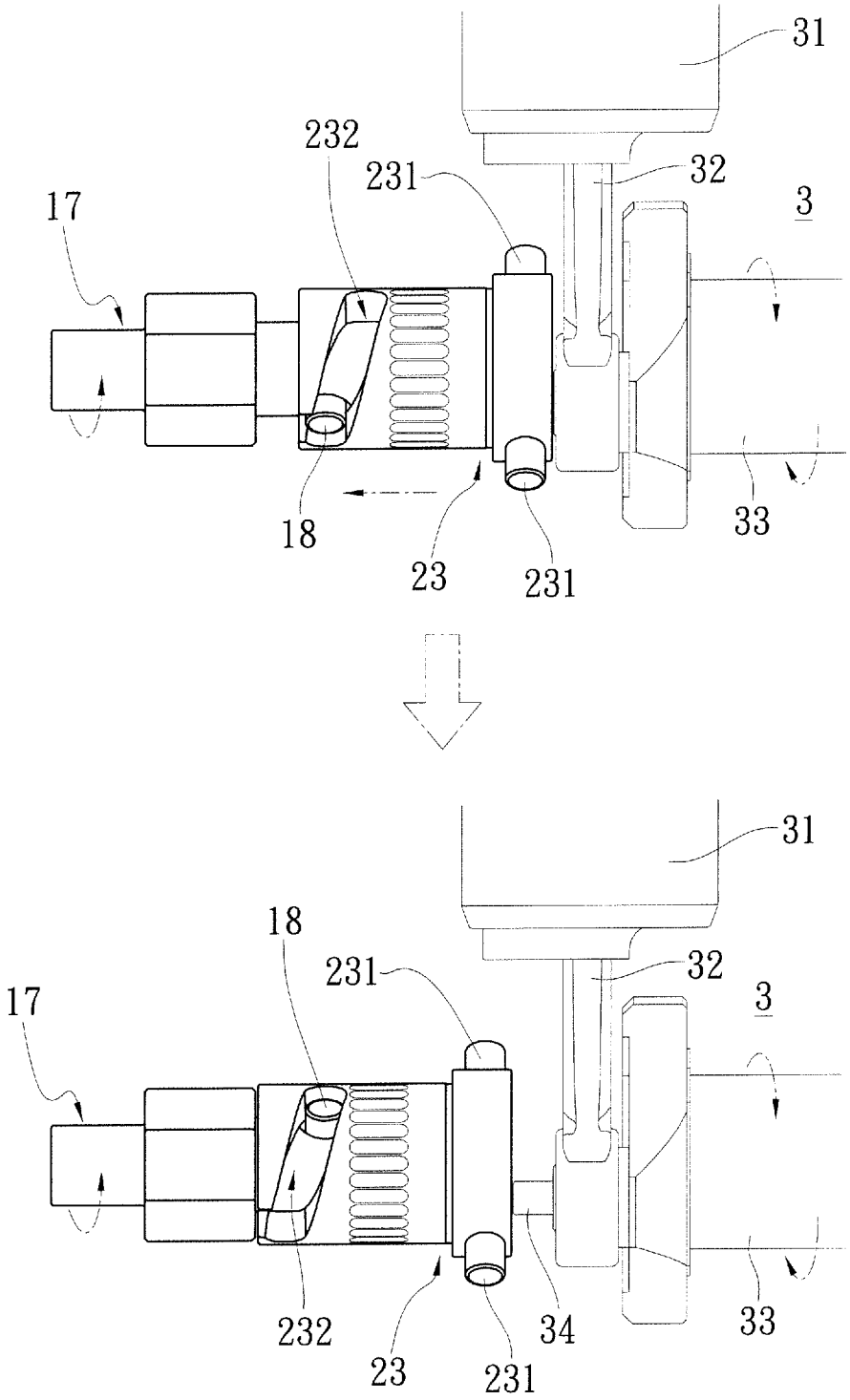
FIG. 6 is a schematic view illustrating an operation of the first embodiment of the present invention after the engine has been started.

Referring to FIGS. 4 and 6, after the engine 3 has been started and the user does not further pull the pull cord 14, the rotary member 13 is acted upon by the spring restoration force of the elastic member 16 so that the rotary member 13 and the axle 17 are rotated synchronously in the backward direction and the positioning pin 18 moves upward from the lower closed end of the helical channel 232 (namely the bottom dead center) to an upper closed end of the helical channel 232 (which corresponds to a top dead end). With the above described spatial arrangement of the positioning pin 18 and the helical channel 232 that allows for axial movement and rotation to be performed at the same time, in the same way, the positioning pin 18 drives the sleeve 23 to move along the axle 17 in the backward direction (namely, in the direction away from the engine 3), making the fixation pin 231 separating from the driving position where it drives the engine 3 to start, thereby releasing the driving condition, allowing the output power of the engine 3 not to be impeded by the starting structure of the present invention and not to cause any undesired loss of power.

Practical tests of the present invention show that the power output from the engine can be increased by 15% horsepower in comparison with an engine that does not include the clutching operation. Further, due to the engine operation does not need to carry the loading of rotation of the starting device, the consumption of fuel of the engine can be reduced.

Figure 7:
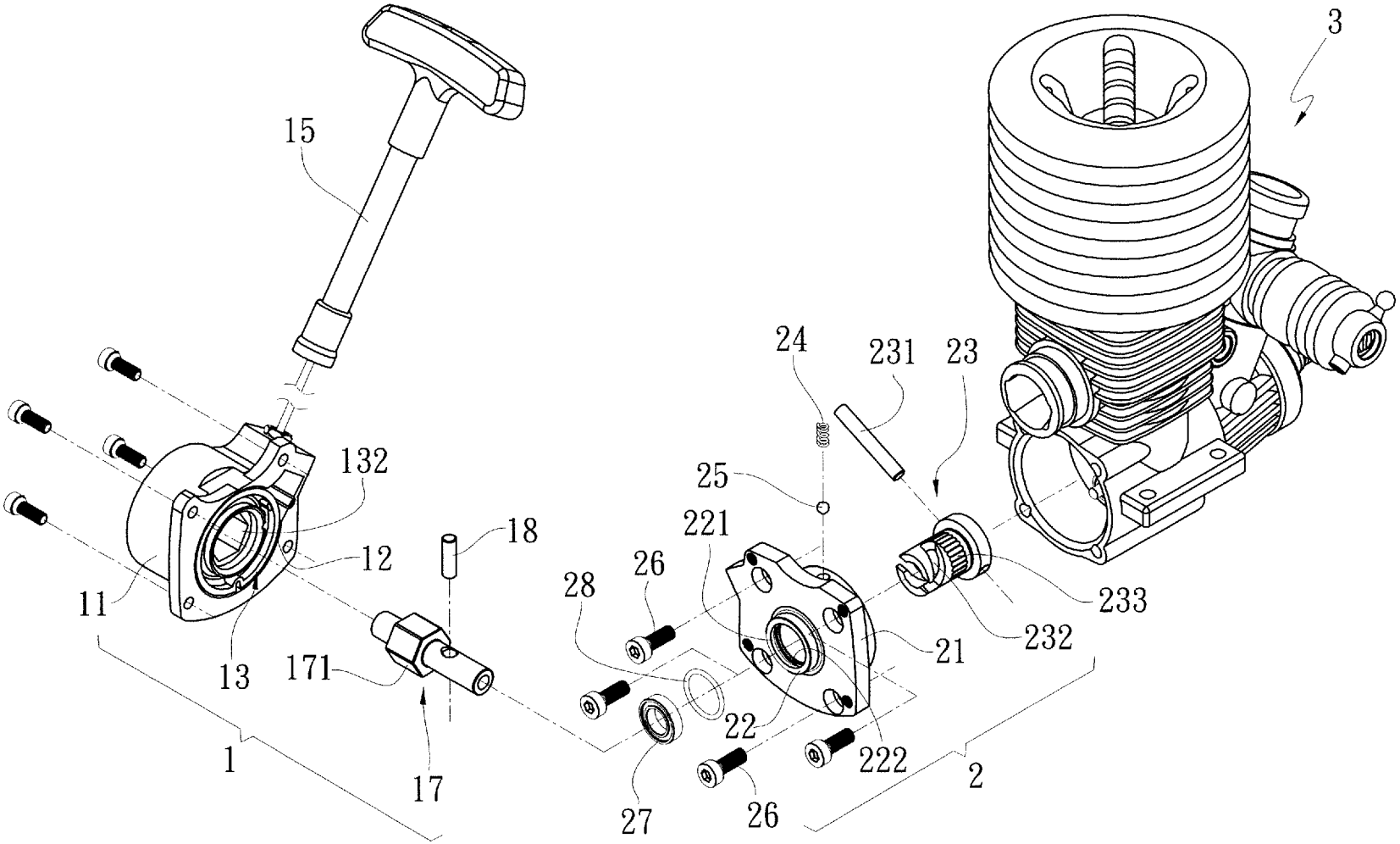
FIG. 7 is an exploded view of a second embodiment of the present invention.
Figure 8:
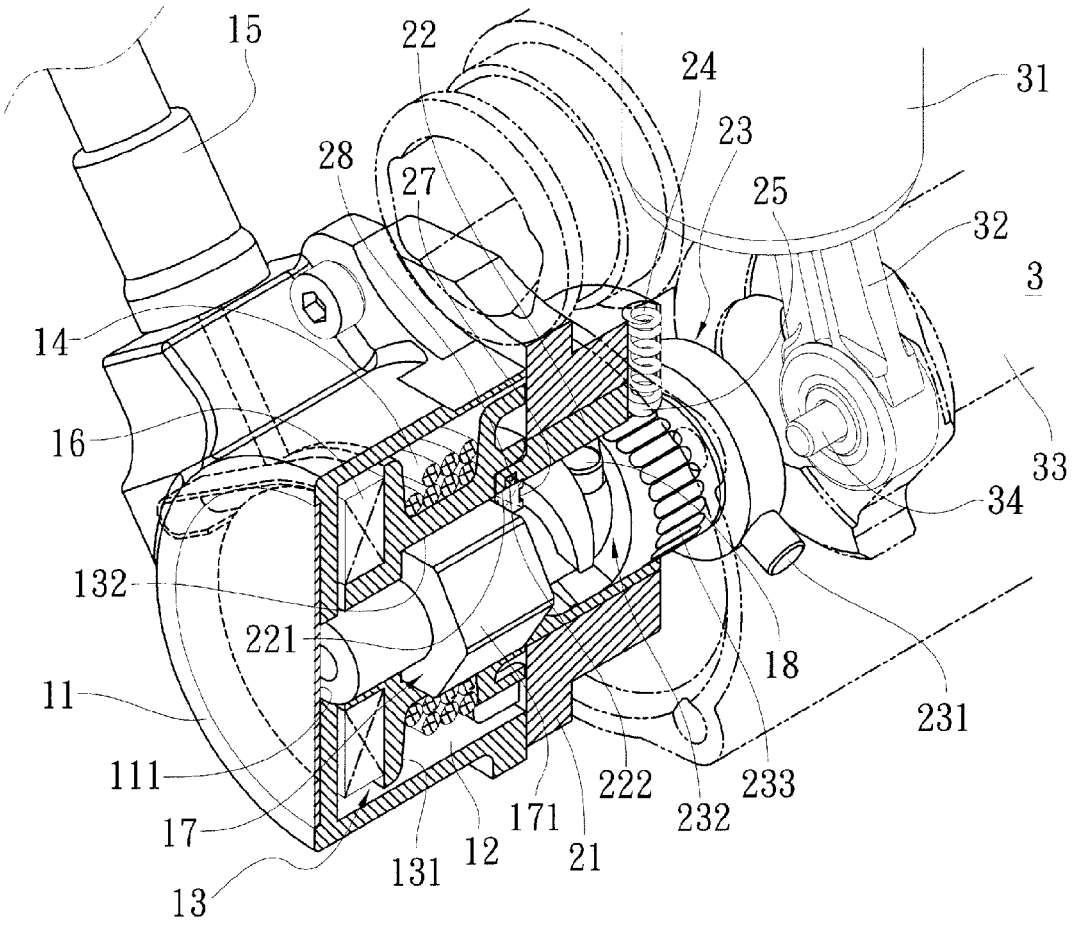
FIG. 8 is a perspective view, partially broken, illustrating the second embodiment of the present invention.
Figure 9:
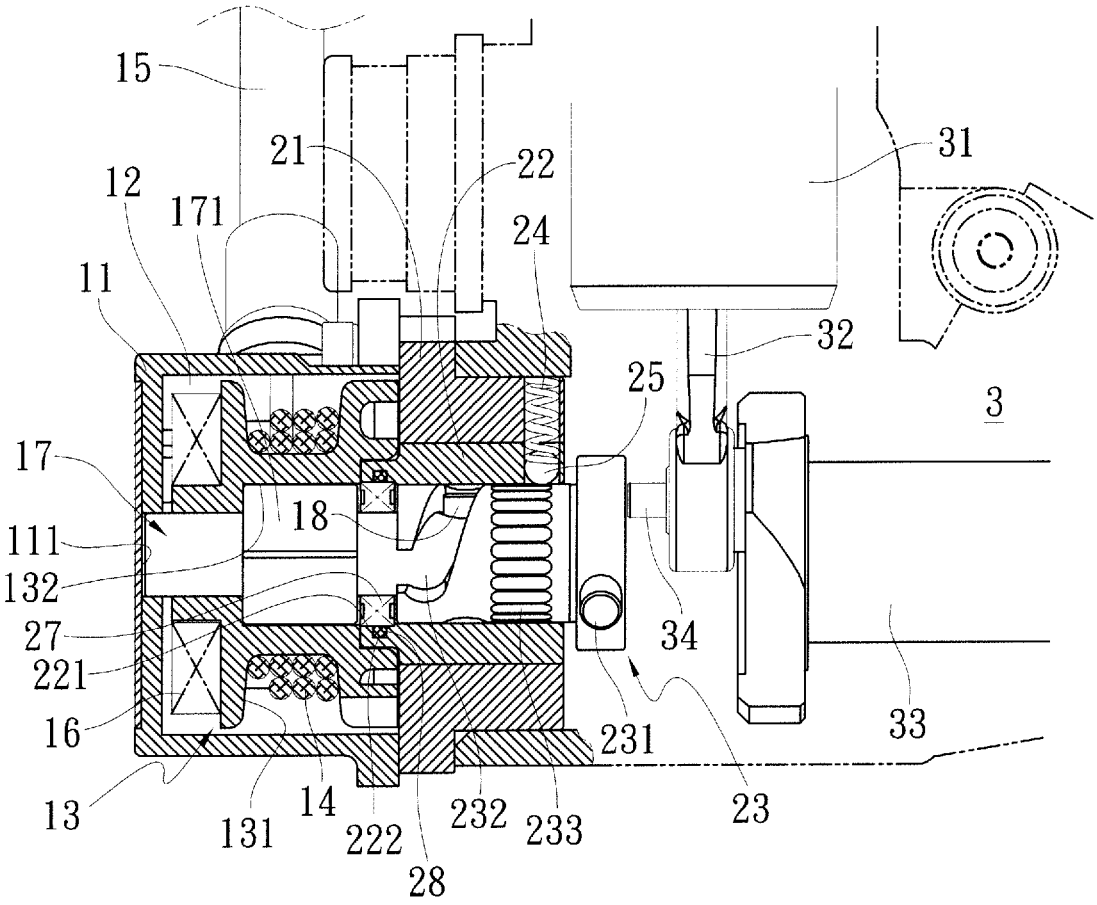
FIG. 9 is a cross-sectional view of the second embodiment of the present invention.

Referring to FIGS. 7-9, the present invention provides another embodiment that is made to improve, for the previously described starting device, sealing tightness and stability of the supporting axis of the axle 17 during the rotation thereof by additionally providing, between coupling surfaces of the driving portion 1 and the driven portion 2, a bearing 27, which is rotatably coupled with the axle 17 so as to support, in a rotatable manner, the supporting axis thereof; and an O-ring 28. In a preferred embodiment of the present invention, the cove 21 comprises the lining 22 mounted to an inside circumferential surface thereof for wear/abrasion protection. The lining 22 comprises a step section 221 formed on an inner circumference thereof and the step section 221 comprises a circumferential groove 222 formed in an inner surface thereof. To assemble, the O-ring 28 is fit into and embedded in the circumferential groove 222 and the bearing 27 is fit to the step section 221 to receive the axle 27 to be fit into and rotatably coupled with the bearing 27. As such, when the engine 3 is started up, the user pulls the pull cord 14 with the handgrip 15, the rotary member 13, together with the axle 17 is caused to rotate, wherein the bearing 27 provides stable supporting axis for the rotation, so that the starting of the engine 3 is made stable and smooth. Further, the O-ring 28 provides an effect of sealing that prevents oil vapor of the engine from being driven into the starting device, leading to an event of oil leaking.

Figure 10:
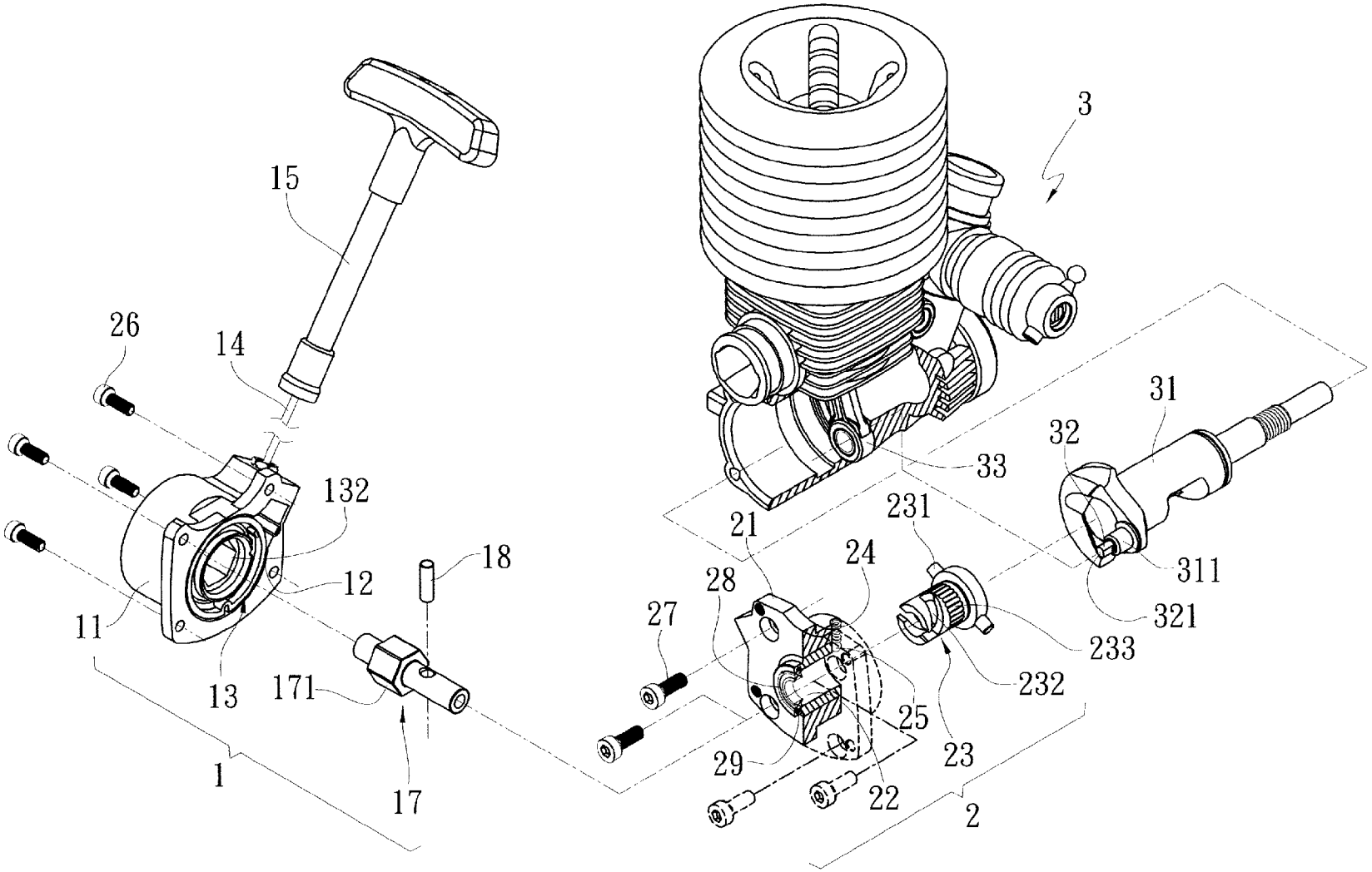
FIG. 10 is an exploded view of a third embodiment of the present invention.
Figure 11:
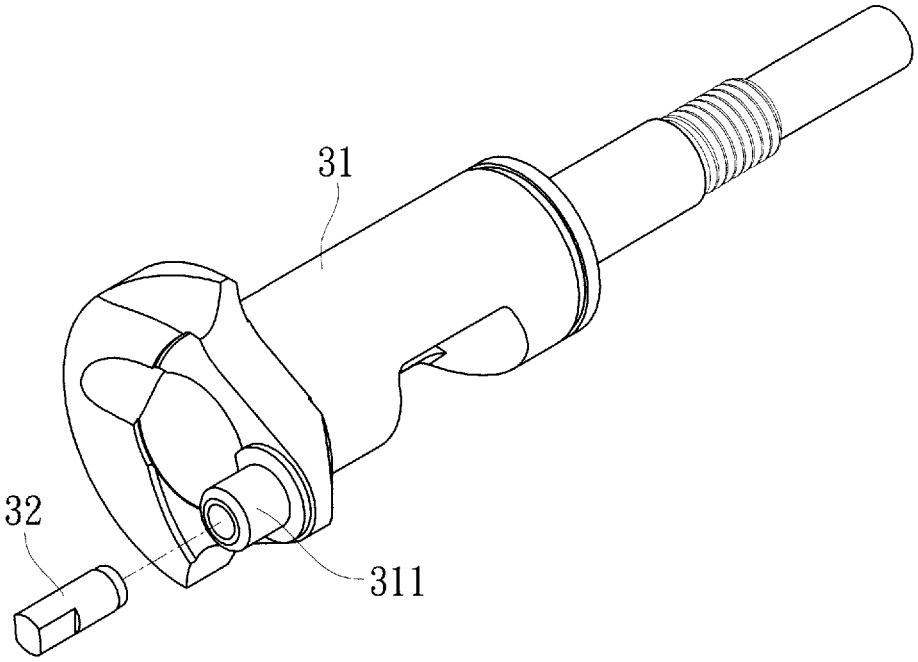
FIG. 11 is an exploded view showing an engine main shaft of the third embodiment of the present invention.
Figure 11A:
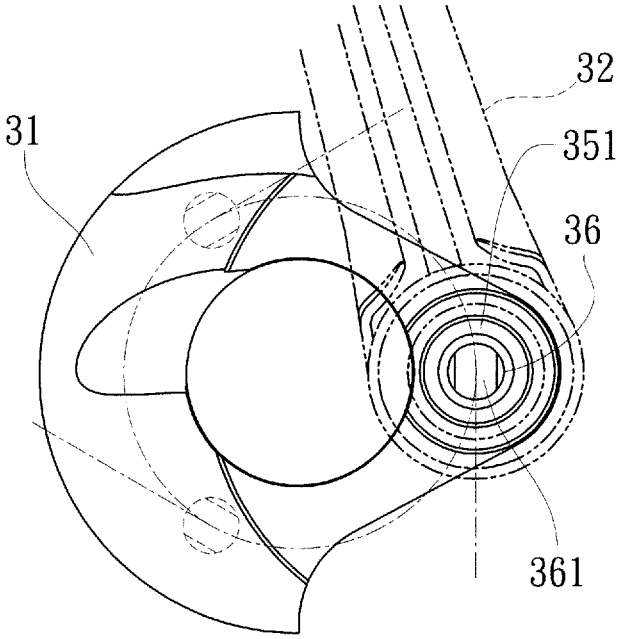
FIG. 11*a* is a front view of FIG. 11 in an assembled condition.
Figure 11B:
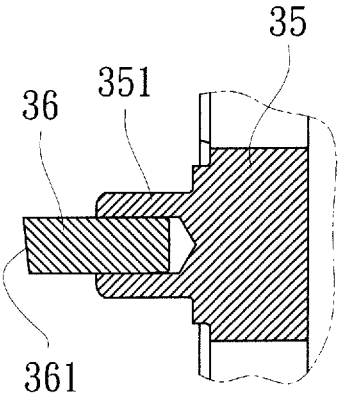
FIG. 11*b* is a schematic side elevational view, in a sectioned form, illustrating a portion of FIG. 11 in an assembled condition.
Figure 12:
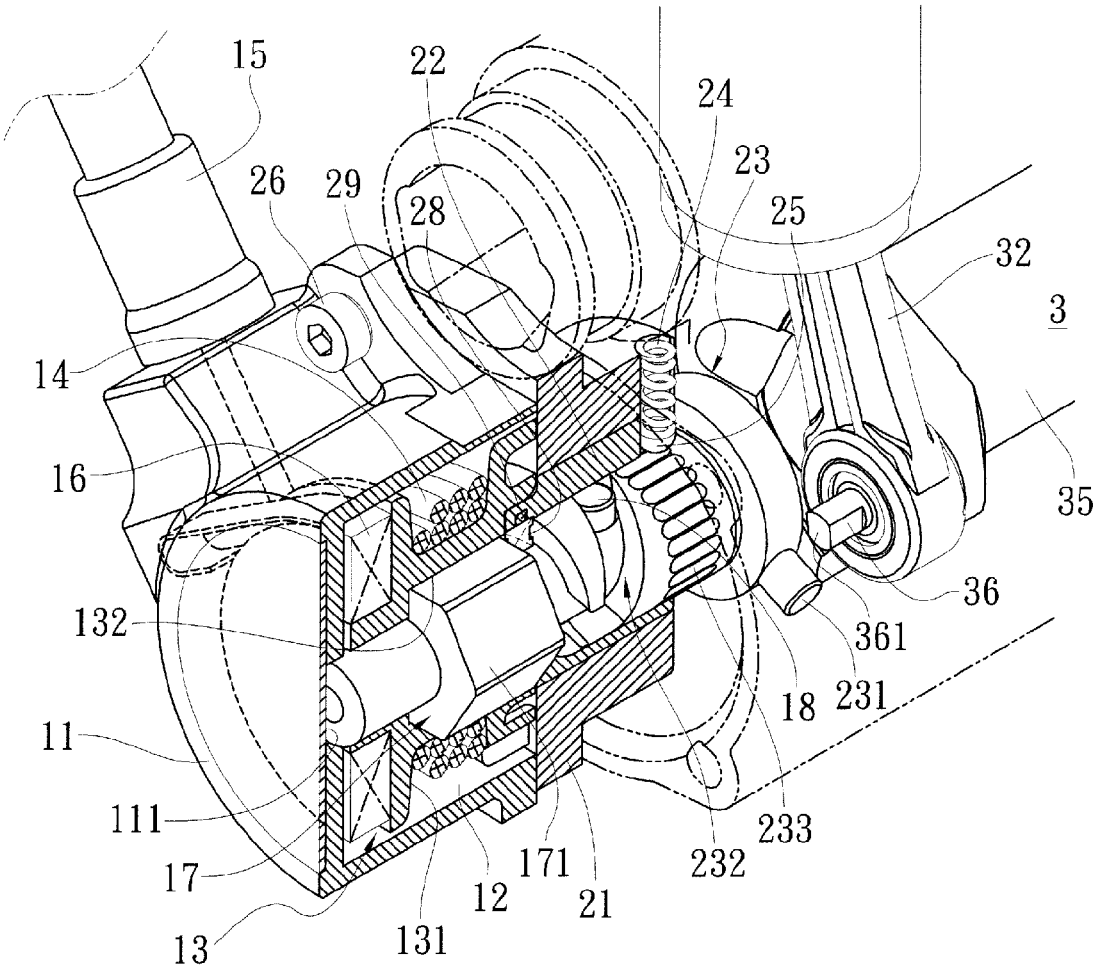
FIG. 12 is a perspective view, partially broken, showing the third embodiment of the present invention.

Referring to FIGS. 10-12, the present invention provides another embodiment that is a further improvement of structure made to eliminate potential risks of jamming of the previously described starting device when the starting device is operated to start up an engine 3. The instant embodiment is made such that the engine has a main shaft 35 that comprises an eccentric peg 36 having an outer end that forms a slope surface 361 (see FIG. 11*b*). In a practical way of embodying the present invention, an end face of the engine main shaft 35 is provided with a holed portion 351. The holed portion 351 has an outer circumference to which the crank 32 is rotatably coupled. The holed portion 351 has an interior compartment in which the eccentric peg 36 that has the slope surface 361 formed on an outer end thereof is received and fixed. To assemble, the eccentric peg 36 is set such that the slope surface 361 inclines in a rotation direction (for example clockwise) of the engine main shaft 35 and an included angle formed between the inclination direction of the slope surface 361 and a circumference of a rotation path thereof that is at an angle of tangent is the optimum arrangement (see FIG. 11*a*) and is preferably fixed in the holed portion 351 of the engine main shaft 35 through interference fitting.

Figure 13:
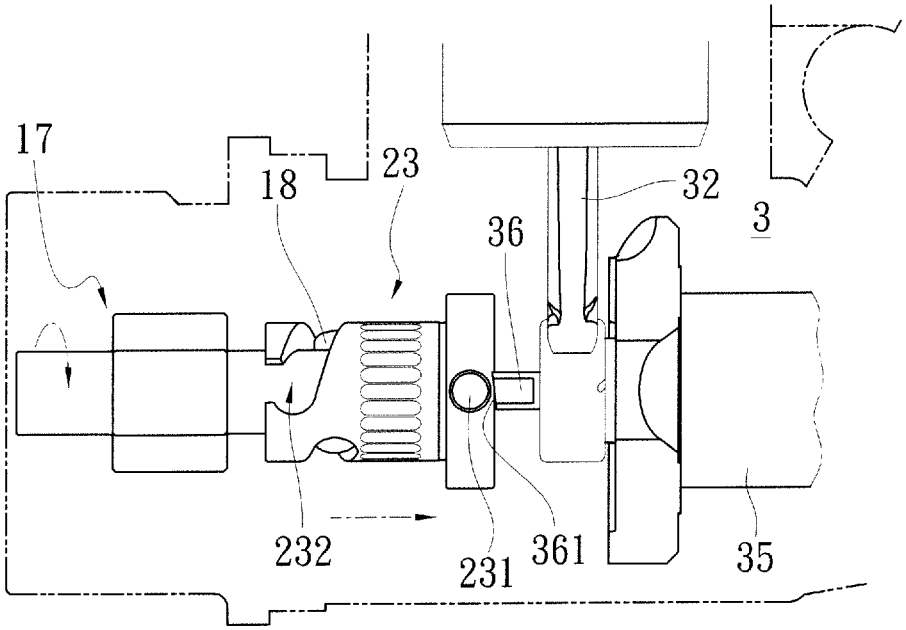
FIG. 13 is a schematic view, partially broken, illustrating a starting operation of the third embodiment of the present invention.
Figure 13A:
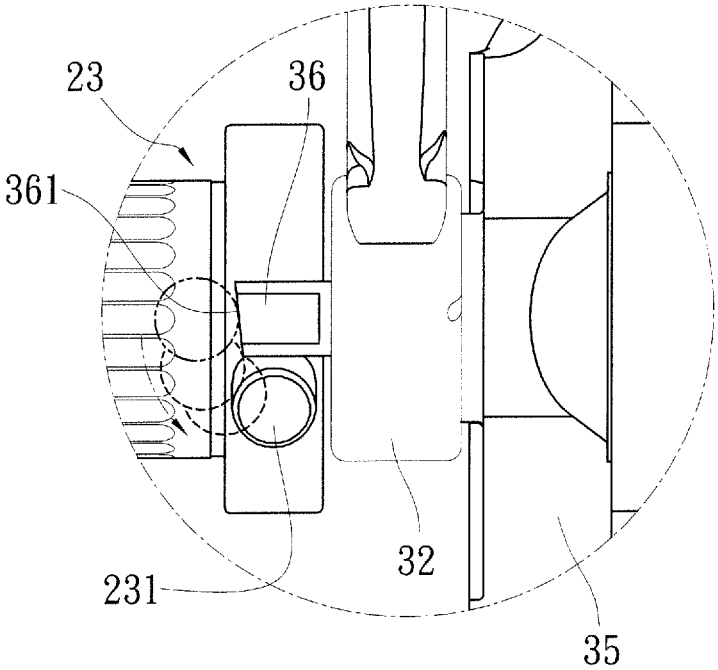
FIG. 13*a* is another schematic view, partially broken, illustrating a starting operation of the third embodiment of the present invention.
Figure 14:
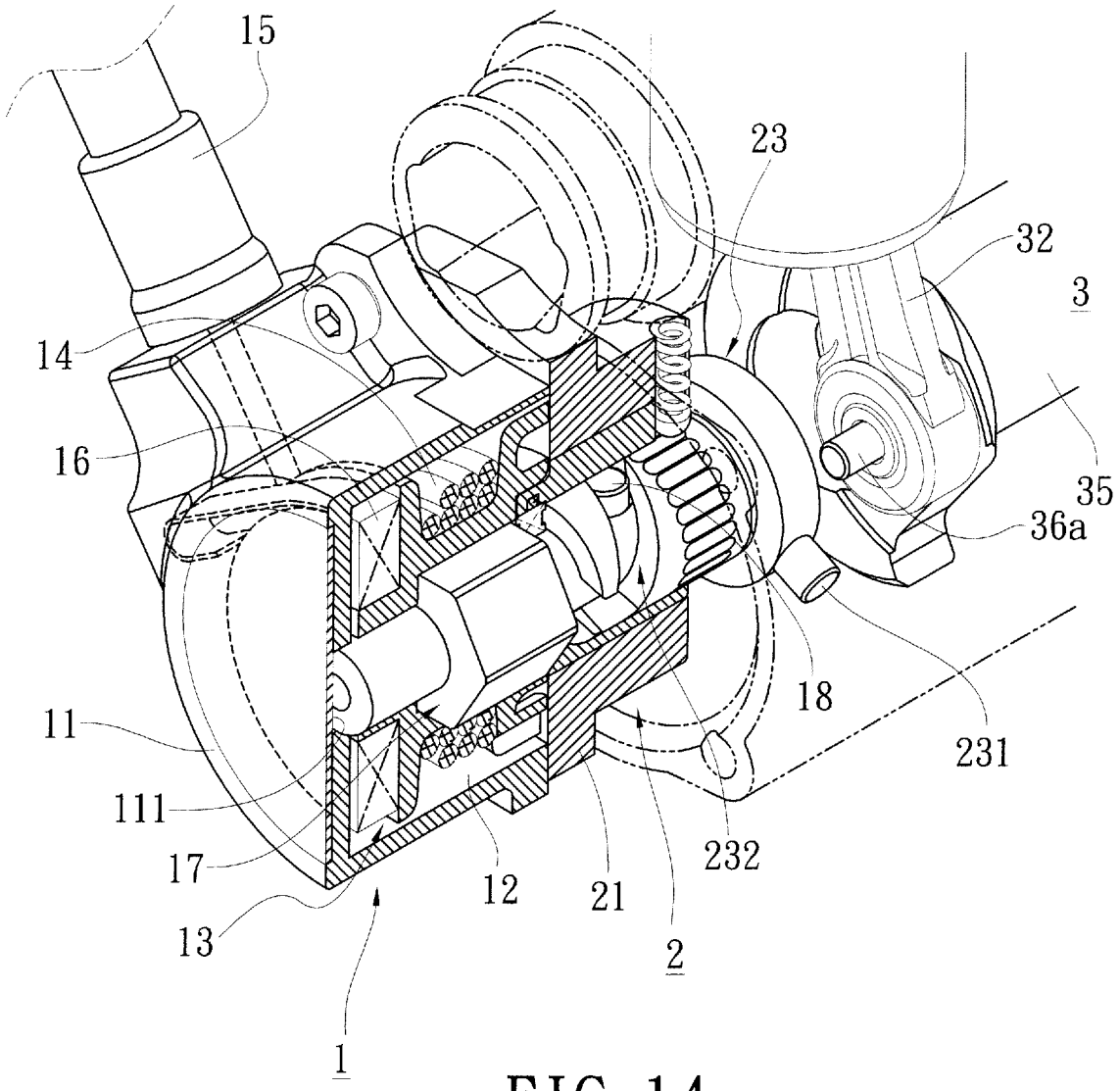
FIG. 14 is a perspective view, partially broken, illustrating a starting device of the first embodiment of the present invention.
Figure 15:
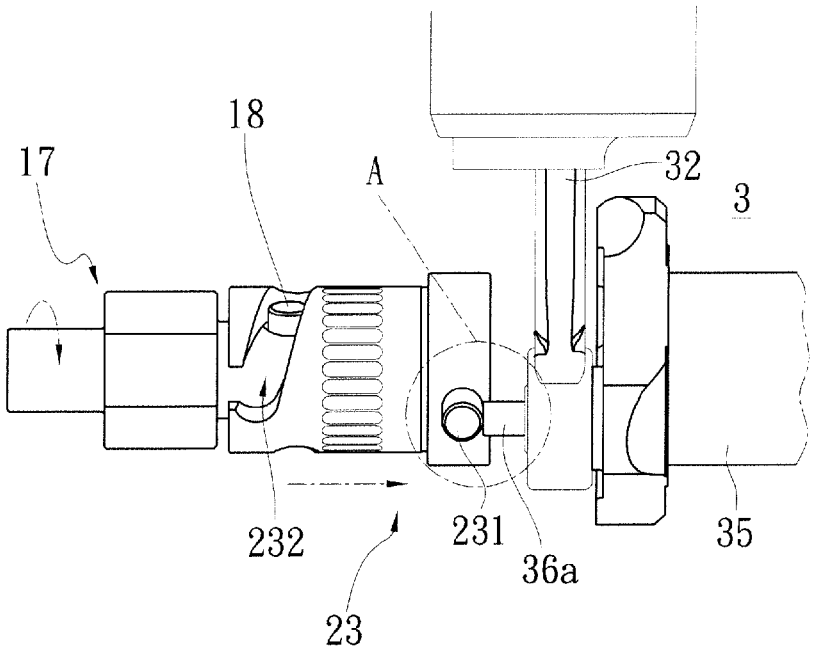
FIG. 15 is a schematic view illustrating a jamming condition of the starting device of the first embodiment of the present invention.
Figure 15A:
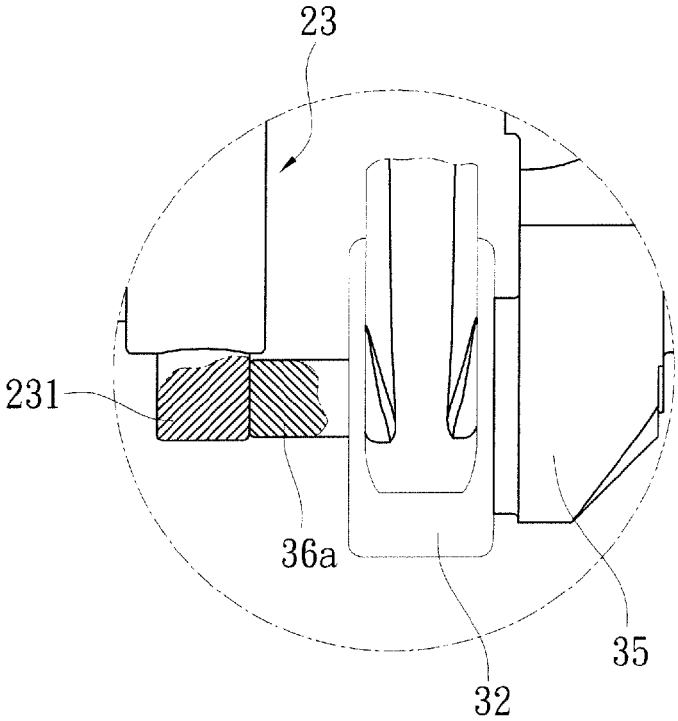
FIG. 15*a* is a side elevational view, partially sectioned, illustrating the jamming condition of the starting device of the first embodiment of the present invention.

Referring to FIGS. 13 and 13*a*, to start up the engine 3, a user uses the handgrip 15 to pull the pull cord 14 so as to cause the cord reel 13 to rotate simultaneously with the axle 17. The axle 17 drives the positioning pin 18 to rotate. Since the positioning pin 18 is received, in a manner of being guided thereby, in the helical channel 232 of the sleeve 23, the positioning pin 18 is rotated along the helical channel 232 and thus moved axially. During the movement of the positioning pin 18, the positioning pin 18 is rotated while being kept at a fixed axial position, and due to the guidance of movement in a helical manner achieved with the helical channel 232, the sleeve 23 is caused to make an axial movement. With the positioning pin 18 received in the helical channel 232, a driving force is applied thereby to a side wall of the helical channel 232 to drive the sleeve 23 to move axially along and with respect to the axle 17 in such a manner that the sleeve 23 moves towards the engine main shaft 35, whereby the sleeve 23 is allowed to reach such a position where the fixation pin 231 engages and drives the eccentric peg 36 mounted to the engine main shaft 35.

Further, when the sleeve 23 is moved in the direction toward the engine main shaft 35 to such a location where the eccentric peg 36 is on a path of movement of the fixation pin 231 of the sleeve 23, the present invention makes use of the arrangement of the slope surface 361 of the end of the eccentric peg 36 to have the fixation pin 231 smoothly guided by the slope surface 361 to move in direction away from engagement thereof with the end of the eccentric peg 36 so that the fixation pin 231 is allowed to contact and engage a side surface of the eccentric peg 36 and thus driving the piston crank 32 to move for starting up the operation of the engine 3. As such, jamming of the engine 3 during staring up by the starting device can be eliminated.

In summary, the present invention provides a hand-operating starting device with a clutch structure, which allows for ready engagement and disengagement between the starting structure and an engine and allows a user to start the engine by hand-pulling a pull cord based starting structure and requiring no electrical device and thus no additional electrical power to achieve starting of engine. In addition, the operation of the starting device is made stable, smooth, and oil leaking proof and absolutely no jamming may occur during the operation thereof so that oblivious enhancement in respect of performance can be achieved compared to the known starting device. Compared to the conventional engine starting devices, the present invention, as a whole, is novel.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A hand-operating starting device with clutch structure, mountable to one side of an engine, comprising:

a driving portion, which comprises a housing defining a receiving section, the receiving section receiving therein a rotary member around which a pull cord is windable, the pull cord having an end extending outside the housing, the pull cord having an opposite end fixed to the rotary member, the rotary member comprising an elastic member mounted to one end thereof to provide a restoration force for reverse rotation of the rotary member after the rotary member has been rotated, the rotary member being coupled to an axle, the axle having a surface from which a positioning pin projects; and a driven portion, which comprises a cover, the cover being set to cover the receiving section of the housing, a sleeve that comprises a fixation pin and a helical channel formed thereon being received in the cover in such a way that the sleeve is movably fit over the axle and the positioning pin is received in and guided by the helical channel, whereby the sleeve is rotatable and is movable, during the rotation thereof, to a position where the fixation pin is in driving engagement with the engine, characterized in that the sleeve has a circumferential surface in which a plurality of positioning grooves is formed and circumferentially distributed, the cover comprising a spring arranged in a radial passage so that the spring biases a positioning ball to set the positioning ball in an elastically biased condition to selectively fit into and engage the positioning grooves;

a bearing is arranged between coupling surfaces of the driving portion and the driven portion to be rotatably coupled with the axle so as to serve as a supporting axis for rotation, the bearing comprising an O-ring fit over an outer circumference thereof, wherein the cover comprises a lining mounted to an inside surface thereof, the lining comprising a step section formed on an inner circumference thereof, the step section comprising a circumferential groove formed in an inner surface thereof, the O-ring being fit into and embedded in the circumferential groove, the bearing being fit to the step section to thereby achieve an effect of sealing; and the engine comprises a main shaft that comprises an eccentric peg projecting therefrom and having an outer end on which a slope surface is formed, the slope surface inclining in a rotation direction (clockwise) of the main shaft.

2. The hand-operating starting device with clutch structure according to claim 1, wherein the end of the pull cord is coupled to a handgrip for hand gripping.

3. The hand-operating starting device with clutch structure according to claim 1, wherein the rotary member comprises a polygonal bore, the axle comprising a polygonal coupling section corresponding in shape to the polygonal bore so that the polygonal coupling section of the axle is insertable into the polygonal bore of the rotary member.

4. The hand-operating starting device with clutch structure according to claim 1, wherein the axle has an end extending through the rotary member and rotatably received in a recess formed in an inside surface of the housing.

* * * * *